US008764489B2

(12) United States Patent
Blakborn et al.

(10) Patent No.: US 8,764,489 B2
(45) Date of Patent: Jul. 1, 2014

(54) HIGH-CURRENT PLUG-IN CONNECTOR

(75) Inventors: Willem Blakborn, Inzell (DE); Martin Auer, Anger (DE); Gregor Reiner, Traunstein (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 13/812,789

(22) PCT Filed: Jun. 9, 2011

(86) PCT No.: PCT/EP2011/002856

§ 371 (c)(1),
(2), (4) Date: Jan. 28, 2013

(87) PCT Pub. No.: WO2012/013258

PCT Pub. Date: Feb. 2, 2012

(65) Prior Publication Data

US 2013/0130556 A1 May 23, 2013

(30) Foreign Application Priority Data

Jul. 29, 2010 (DE) ..... 20 2010 010 827 U

(51) Int. Cl.
*H01R 24/00* (2011.01)

(52) U.S. Cl.
USPC ..... 439/626

(58) Field of Classification Search
USPC ..... 439/788, 626, 825, 840–841, 246, 249, 439/268, 264, 259, 843, 66, 86, 690, 654
See application file for complete search history.

(56) References Cited

U.S. PATENT DOCUMENTS

| | | | | |
|---|---|---|---|---|
| 4,514,025 | A | 4/1985 | Maulandi | |
| 4,531,174 | A | 7/1985 | Rickmann | |
| 4,632,496 | A * | 12/1986 | Williams | 439/841 |
| 4,810,213 | A | 3/1989 | Chabot | |
| 8,057,270 | B2 * | 11/2011 | Shimazu et al. | 439/827 |
| 8,437,855 | B2 * | 5/2013 | Sjostedt et al. | 607/37 |
| 8,480,437 | B2 * | 7/2013 | Dilmaghanian et al. | 439/669 |
| 2004/0224572 | A1 | 11/2004 | Hielscher | |

* cited by examiner

*Primary Examiner* — Edwin A. Leon
(74) *Attorney, Agent, or Firm* — DeLio, Peterson & Curcio, LLC; Robert Curcio

(57) ABSTRACT

A high-current plug-in connector for transmitting electrical currents, having a housing made of electrically conducting material, designed to mechanically and electrically connect to a cable, the housing having at least one open side for inserting a mating plug-in connector made of an electrically conducting material, and forming a chamber for accommodating the mating plug-in connector, and at least one contact element, which is arranged on the housing and designed so that the contact element establishes an electrical contact having a contact area and a contact pressure between the housing and the mating plug-in connector inserted into the housing, wherein the contact element is designed as a coil spring.

18 Claims, 9 Drawing Sheets

HIGH-CURRENT PLUG-IN CONNECTOR

BACKGROUND OF THE INVENTION

1. Field of the Invention

The present invention relates to a high-current insertion-connected connector for transmitting electrical currents, having a housing made of electrically conductive material which is designed to be connected mechanically and electrically to a cable, which has at least one open side or end for the insertion of a mating insertion-connected connector made of an electrically conductive material, and which creates a chamber to receive the mating insertion-connected connector, and having at least one contact member which is so arranged against the housing and is so designed that it makes an electrical contact, at which there is an area of contact and contact-making pressure, between the housing and a mating insertion-connected connector inserted into the housing.

2. Description of Related Art

High-current insertion-connected connectors for transmitting high electrical currents are used for example in motor vehicles having electric drives or hybrid drives. The term "high current" or "high current intensities" is generally in reference to electrical currents of a current intensity of 100 A, 200 A, 300 A, 400 A or more. What is provided in this case is a high-current insertion-connected connector having a housing, into which a contact-making blade can be inserted as a mating insertion-connected connector. Both the housing and the blade-type contact are made of an electrically conductive material and are connected to suitable cables for conducting electrical current.

SUMMARY OF THE INVENTION

Bearing in mind the problems and deficiencies of the prior art, it is therefore an object of the present invention to provide a high-current insertion-connected connector of the above kind in respect of its electrical properties even when subject to mechanical loads such for example as vibration.

This object is achieved in accordance with the invention by a high-current insertion-connected connector of the above kind which has the features characterized as described below and in the claims.

The above and other objects, which will be apparent to those skilled in the art, are achieved in the present invention which is directed to a high-current insertion-connected connector for transmitting electrical currents, comprising: a housing including electrically conductive material, the housing designed to be connected mechanically and electrically to a cable, and having at least one open side or end, and forming a chamber for receiving a mating insertion-connected connector; the mating insertion-connected connector for insertion within the housing, made of an electrically conductive material; at least one contact member arranged against the housing to make an electrical contact, at which there is an area of contact and a contact-making pressure, between the housing and the mating insertion-connected connector inserted into the housing, the at least one contact member including a coil spring, there being arranged in the housing, in the chamber to receive the mating insertion-connected connector; and a mounting member made of an electrically insulating material to hold the at least one contact member in a predetermined position, the mounting member receiving the mating insertion-connected connector, and including, for each of the at least one contact member in the form of a coil spring, a spigot having a free end, on each of which spigots the coil spring is so arranged that the spigot engages axially in turns of the coil spring.

The mating insertion-connected connector may comprise a blade-type insertion-connected connector, an insertable blade, or a contact-making blade.

A central longitudinal axis of the coil spring is preferably aligned parallel to a straight line. Two, three, four, or more coil springs may be employed, with central longitudinal axes of each of the coil springs being aligned parallel to one another.

The at least one contact member in the form of the coil spring is designed to make electrical and mechanical contact with the housing and the mating insertion-connected connector at radially outer sides of turns of the coil spring.

A longitudinal center axis of at least one turn of the coil spring is preferably tilted relative to a longitudinal center axis of the coil spring by a predetermined angle greater than zero.

The mounting member may be formed in two parts. The mounting member may include apertures, with the at least one contact member in the form of a coil spring making electrical and mechanical contact with the housing by fitting through an aperture and projecting into the chamber within the housing for the mating insertion-connected connector.

In a preferred embodiment, the mounting member may include two flaps facing one another, resiliently deflectable, the flaps having a spacing therebetween smaller than the thickness of the mating insertion-connected connector.

A radial diameter of the at least one contact member in the form of the coil spring is preferably perpendicular to a central longitudinal axis of the coil spring and greater than a distance between the housing and a mating insertion-connected connector inserted in the housing.

Still other objects and advantages of the invention will in part be obvious and will in part be apparent from the specification.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
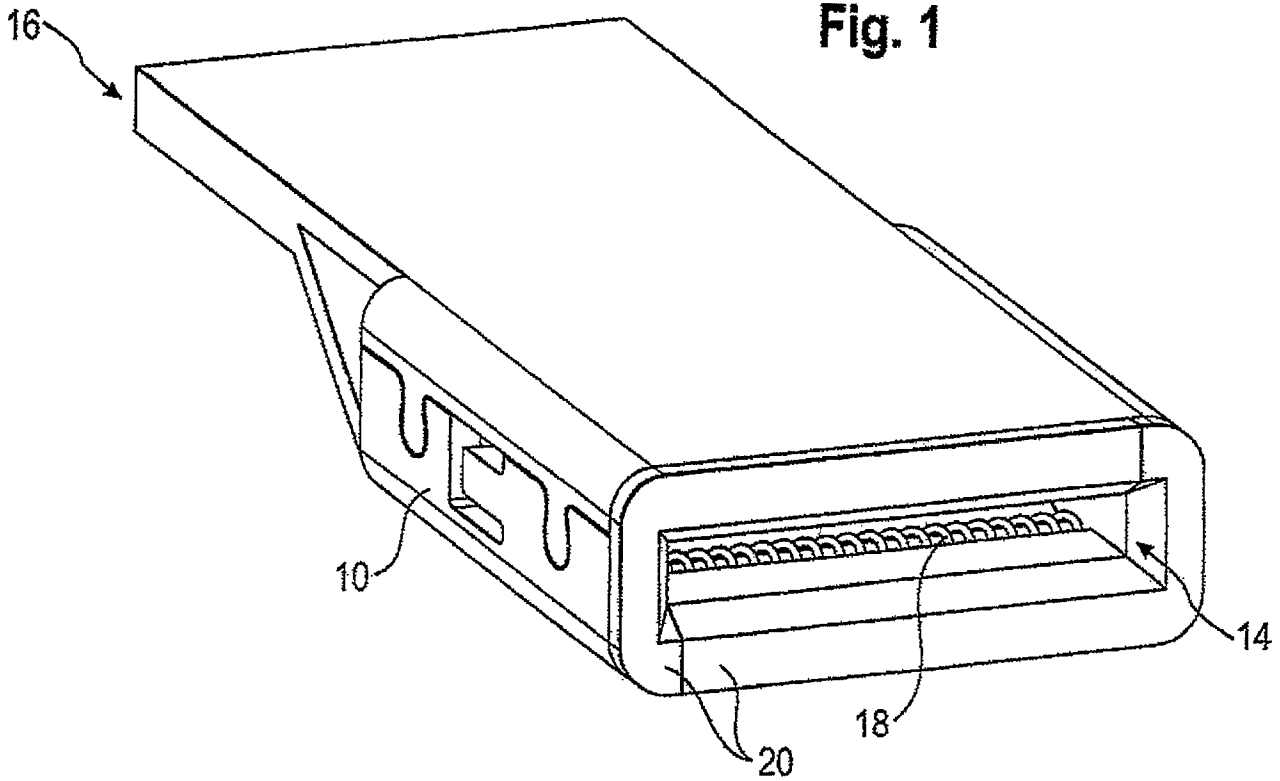
FIG. 1 is a perspective view of an illustrative embodiment of high-current insertion-connected connector according to the invention.
Figure 2:
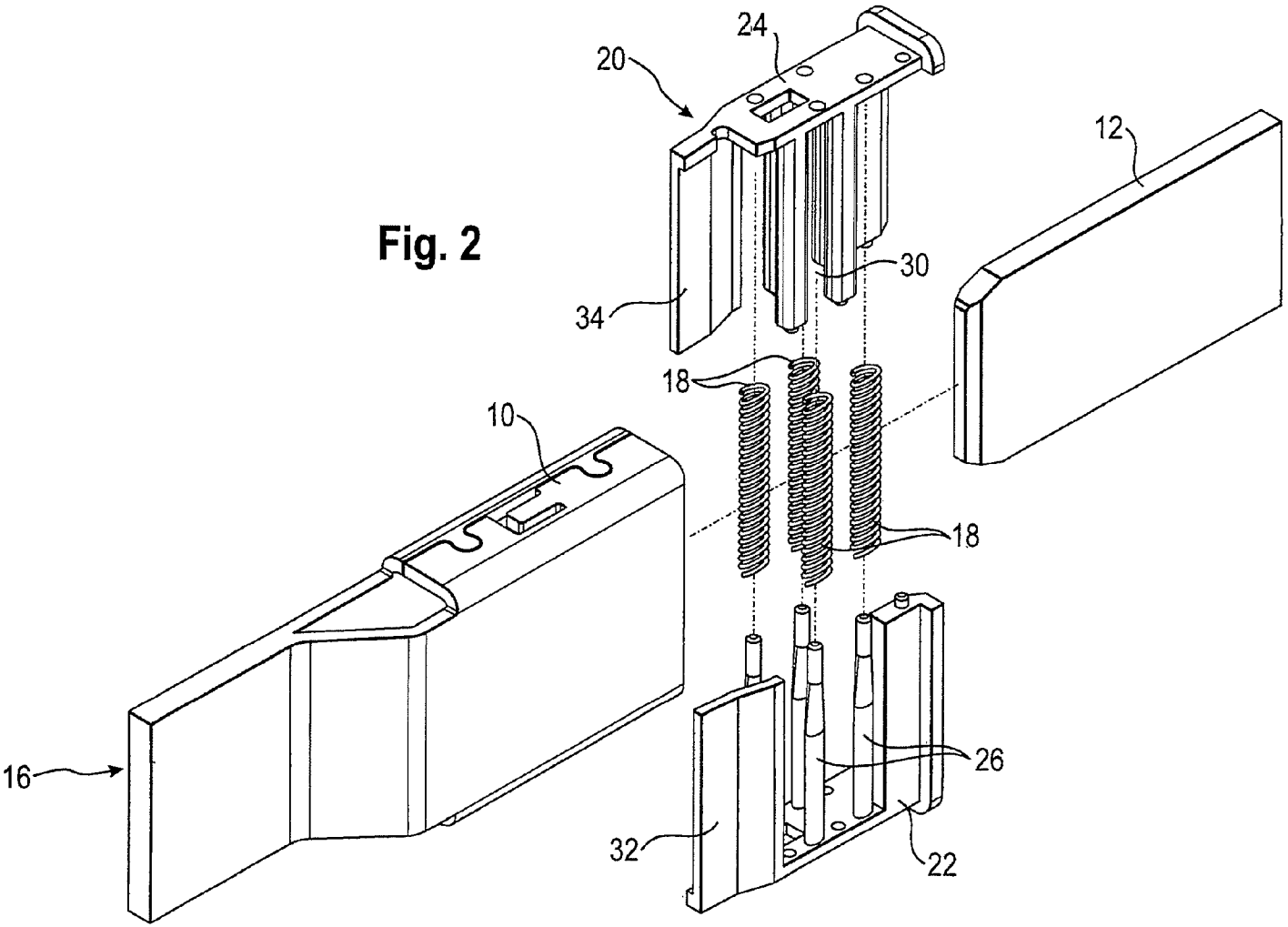
FIG. 2 is an exploded view of the high-current insertion-connected connector shown in FIG. 1.
Figure 3:
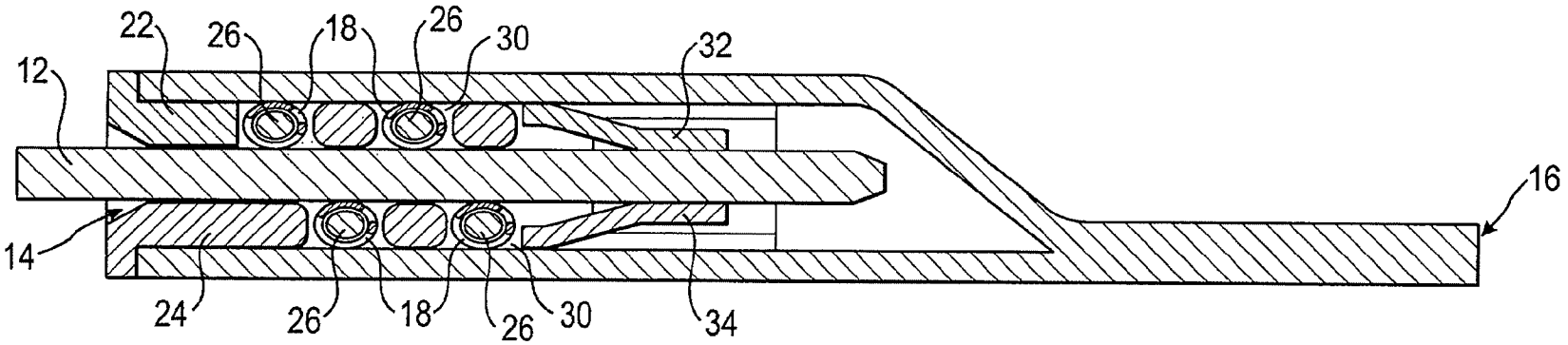
FIG. 3 is a view in section of the high-current insertion-connected connector shown in FIG. 1 when a mating insertion-connected connector is inserted.
Figure 4:
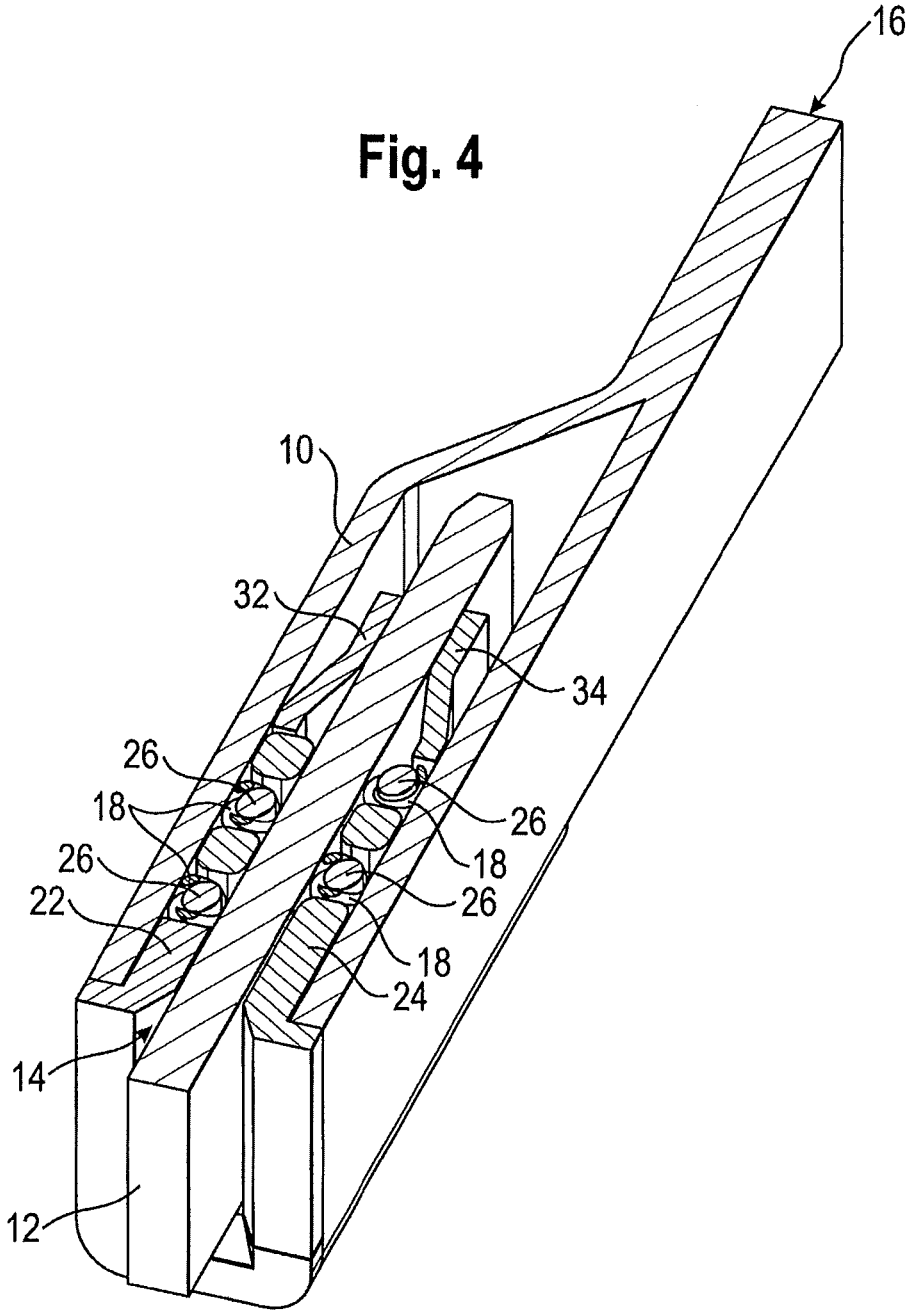
FIG. 4 is a perspective view in section of the high-current insertion-connected connector shown in FIG. 1 when a mating insertion-connected connector is inserted.
Figure 5:
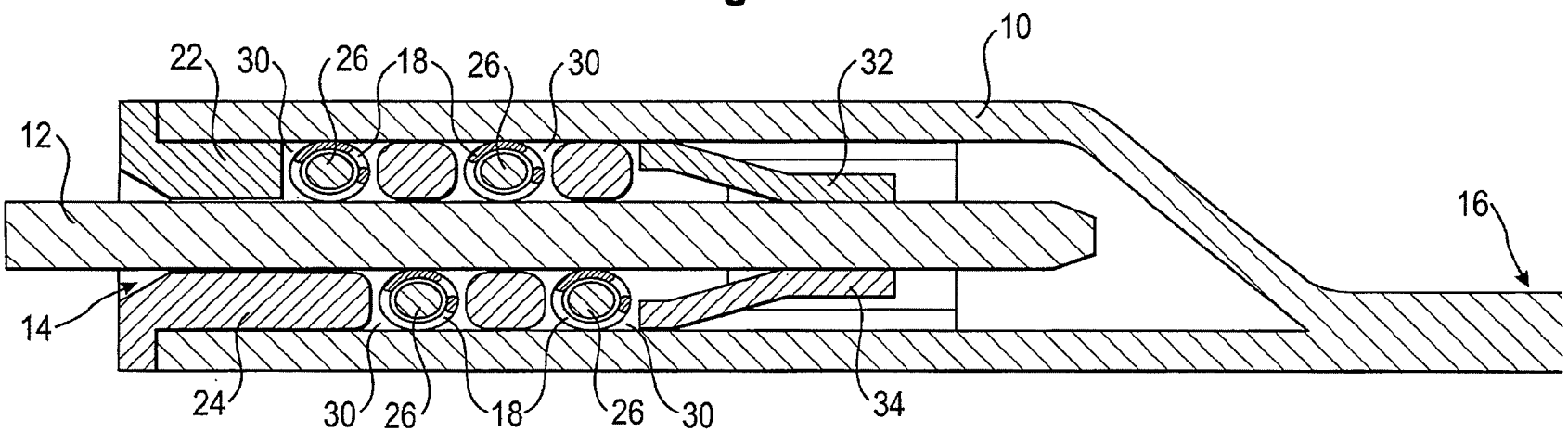
FIG. 5 is a view in section of the high-current insertion-connected connector shown in FIG. 1 when a mating insertion-connected connector is inserted.

In describing the preferred embodiment of the present invention, reference will be made herein to FIGS. 1-10 of the drawings in which like numerals refer to like features of the invention.

In a high-current insertion-connected connector of the above kind, provision is made in accordance with the invention for the contact member to take the form of a coil spring.

This has the advantage that, when there is a need for the space occupied to be particularly small, reliable electric contact is made between the housing and the mating insertion-connected connector and even when highly loaded by mechanical vibrations this transmits high electrical currents dependably, without the points of contact being subject to any wear worth mentioning in this case, due to abrasion for example.

Particularly good transmission of high electrical currents is achieved by making the mating insertion-connected connector a blade-type insertion-connected connector, an insertable blade or a contact-making blade.

A construction which is particularly simple mechanically and at the same operates reliably is obtained by arranging the coil spring in such a way that a central longitudinal axis of the coil spring is aligned parallel to a straight line.

Easy assembly of the high-current insertion-connected connector is achieved by providing two, three, four or more coil springs, with the central longitudinal axes of the two, three, four or more coil springs being aligned parallel to one another.

A particularly large number of points of contact together with a correspondingly large overall area of contact are obtained by arranging the at least one coil spring in such a way that it makes electrical and mechanical contact with the housing and the mating insertion-connected connector at respective radially outer sides of turns of the coil spring.

A coil spring which is deformable elastically in the radial direction, or in other words in the direction perpendicular to a longitudinal center axis of the coil spring, and which thus provides a corresponding contact-making pressure in the radial direction, is obtained by tilting a longitudinal center axis of at least one turn of the coil spring, and in particular of all the turns thereof, relative to the longitudinal center axis of the coil spring by a predetermined angle greater than zero.

A particularly simple way of fitting together the high-current insertion-connected connector is achieved by arranging in the housing, in the chamber to receive the mating insertion-connected connector, a mounting member made of an electrically insulating material to hold the at least one coil spring in a predetermined position and by designing the mounting member to receive the mating insertion-connected connector.

A reliably operating way of mounting the coil spring in a predetermined position with, if required, a defined alignment of a coil spring which is, for example elliptical in cross-section is achieved by giving the mounting member, for each coil spring, a spigot having a free end, on each of which spigots a coil spring is so arranged that the spigot engages axially in the turns of the coil spring.

Easy fitting of the coil springs onto the mounting member is achieved by forming the mounting member in two parts.

Particularly good mechanical fixing in place of the coil spring is achieved by giving the mounting member apertures, with at least one coil spring being so arranged that it makes electrical and mechanical contact with the housing by fitting through the aperture and projects into a chamber within the housing for the mating insertion-connected connector.

Clamped fixing of the mating insertion-connected connector in the housing, thus effectively preventing movements of the mating insertion-connected connector relative to the housing even under mechanical vibratory loading, is achieved by giving the mounting member two flaps facing one another which can be resiliently deflected and whose spacing is smaller than the thickness of the mating insertion-connected connector.

Particularly good contact-making pressure in the electrical contact made between the housing and the mating insertion-connected connector is obtained by making a radial diameter of the at least one coil spring perpendicular to a central longitudinal axis of the coil spring greater than a distance between the housing and a mating insertion-connected connector inserted in the housing.

The preferred embodiment of high-current insertion-connected connector according to the invention for transmitting high electrical currents which is shown in FIGS. 1 to 5 comprises a housing 10 made of an electrically conductive material which creates a chamber to receive a mating insertion-connected connector 12 in blade form (FIGS. 2 and 5) and which has, at an insertion end, an opening 14 for the insertion of the mating insertion-connected connector 12. At a cable end 16 opposite from the insertion end, the housing 12 is designed for electrical and mechanical connection to an electrical current cable (not shown). The mating insertion-connected connector 12 too is designed for electrical and mechanical connection to electrical current cable (not shown).

In the housing 10, and in the chamber within the housing 10 for the mating insertion-connected connector 12, four contact members 18 in the form of coil springs made of an electrically conductive material are so arranged and designed that the coil springs 18 make electrical contact between the housing 10 and the mating insertion-connected connector 12 inserted in the housing 10. An illustrative embodiment of the coil springs 18 will be described below by reference to FIGS. 9 and 10. For reasons of clear and simplified representation, the said coil springs 18 are merely shown schematically in FIGS. 1 to 8.

A mounting member 20 is provided to allow the coil springs 18 to be arranged and fixed in the housing 10 at a predetermined point and in a predetermined position relative to the housing 10. Carrying the pre-fitted coil springs 18, it can be inserted into the opening 14 in the housing 10 and latches into the housing 10. The mounting member 20 encloses a chamber to receive the mating insertion-connected connector 12. In other words, the mounting member 20 is so arranged in the housing 10 and so designed that the mating insertion-connected connector 12 is inserted in the mounting member 20, as can be seen from FIG. 5 in particular.

The mounting member 20 is in two parts, being assembled from a first mounting part 22 and a second mounting part 24. The first mounting part 22 has spigots 26 which are integrally formed with the first mounting part 22 and which each have a free end 28. These spigots 26 are used to hold the coil springs 18 and are arranged in apertures 30 in the mounting member 20. To fit them, the coil springs 18 are inserted onto the spigots 26 over the free ends 28 thereof and the first mounting part 22 and the second mounting part 24 are then fitted together. This pre-assembled unit comprising the mounting parts 22, 24 and the coil springs 18 is then slid into the opening 14 in the housing 10 and latches into the housing 10. This is the state which can be seen in FIGS. 3 and 4 in particular. It can also be seen in these Figures that the coil springs 18 make electrical and mechanical contact with the housing 10 at the radially outer sides of their turns. What is more, the coil springs 18 project into the chamber within the housing 10, or rather within the mounting member 20, into which the mating insertion-connected connector 12 is inserted. The state when a mating insertion-connected connector is inserted can be seen in FIG. 5 in particular. What is also apparent in this figure is that, when the mating insertion-connected connector 12 is inserted, the coil springs 18 are clamped-in between it and an inner wall of the housing 10. In other words, in the radial direction the coil springs 18 are elastically compressed radially in opposition to a force from the springs. The returning force which thus results from the coil springs 18 ensures that there is an appropriate contact-making pressure at the points at which the turns make electrical contact between the housing 10 and the mating insertion-connected connector 12 and at which they touch them mechanically. This happens at opposite outer sides of the turns of the coil springs 18. The plurality of turns, which the coil springs 18 have, produce a corresponding plurality of points of contact between the coil spring 18 and the housing 10 on the one hand and between the coil springs 18 and the mating insertion-connected connector 12 on the other hand. The flow of current through the high-current insertion-connected connector is thus distributed over a plurality of individual turns of the coil springs 18 and the individual turns of the coil springs 18 thus each have to transmit only small proportion of the total electrical current. As can be seen from FIGS. 3 to 5 in particular, the coil springs 18 fit through the apertures 30 in the mounting member 20. In other words, the apertures 30 form contact-making windows for the making of electrical and mechanical contact between the housing 10 and the mating insertion-connected connector 12 by the coil springs 18.

Figure 6:
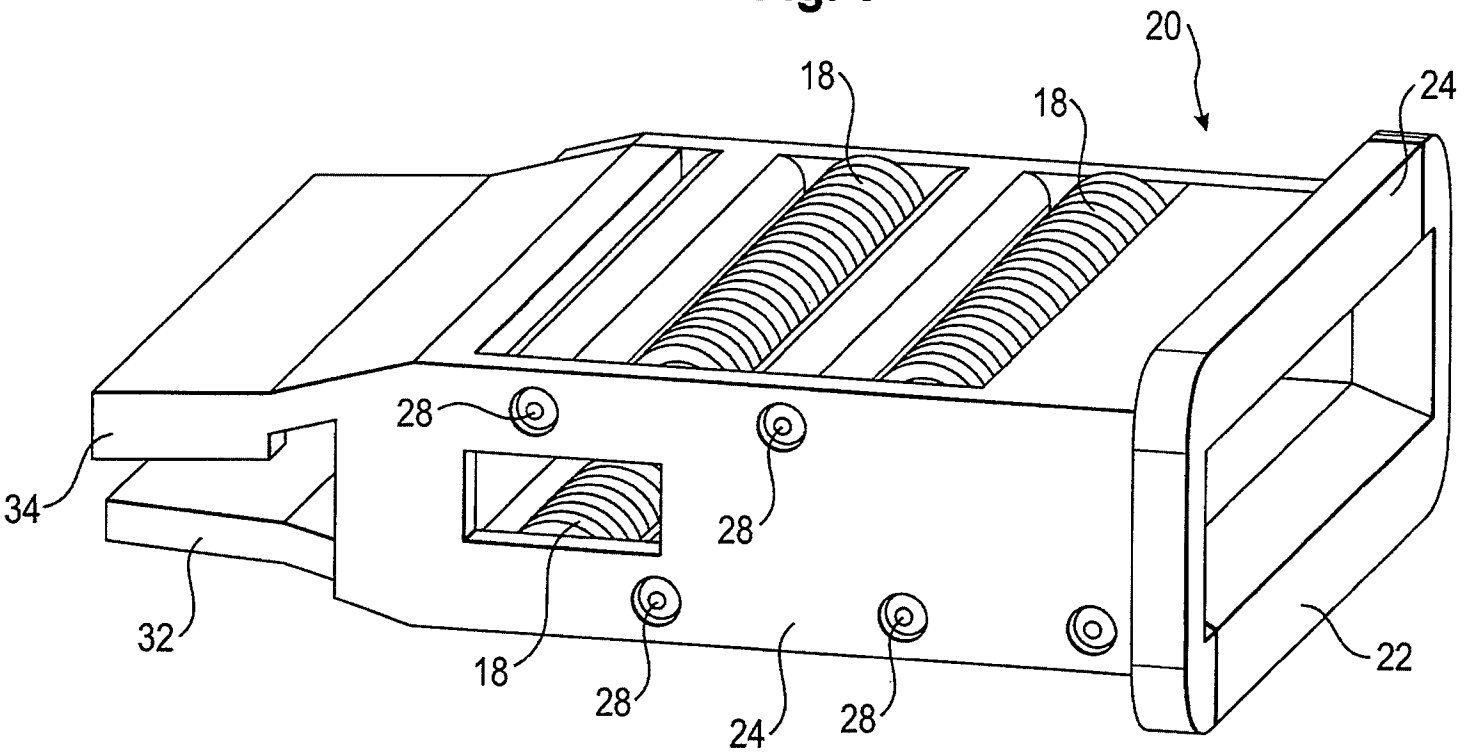
FIG. 6 is a perspective view of a mounting member for the high-current insertion-connected connector shown in FIG. 1.
Figure 7:
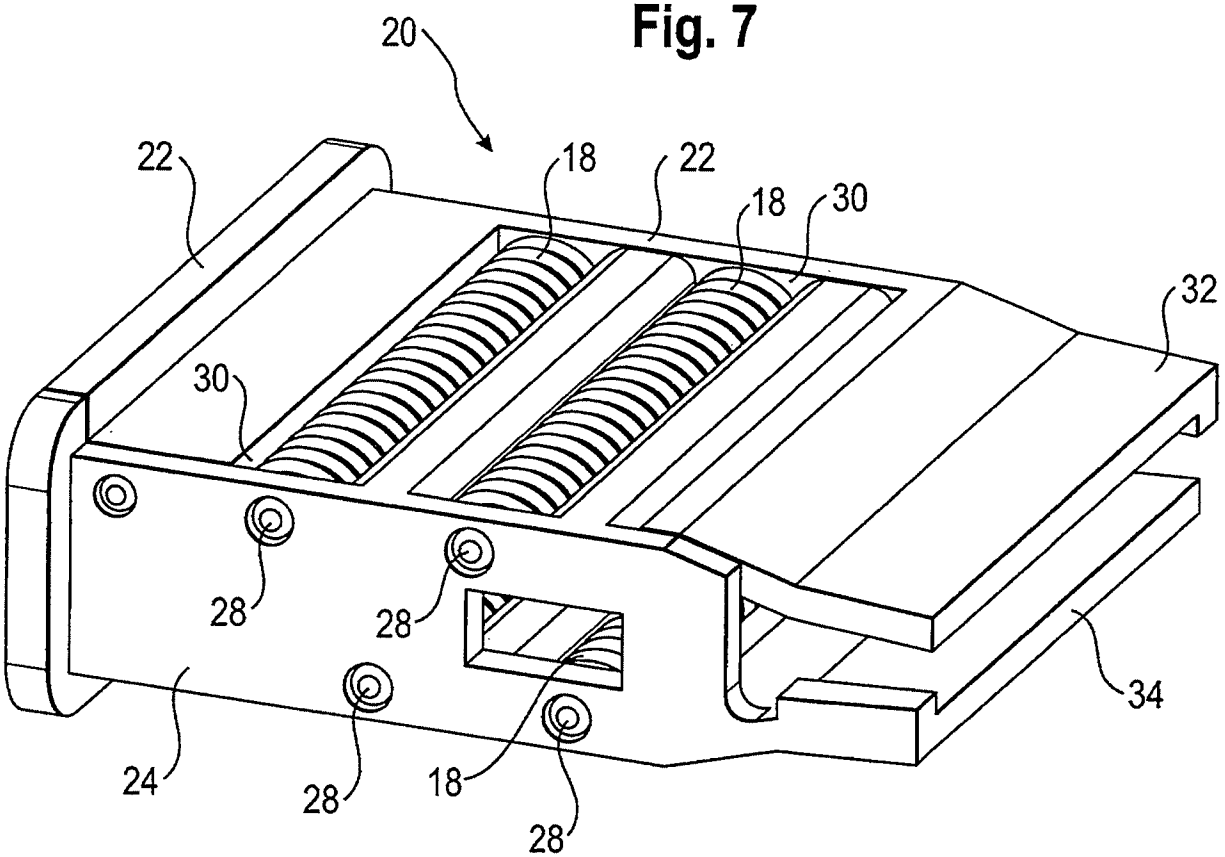
FIG. 7 is a further perspective view of the mounting member shown in FIG. 6.
Figure 8:
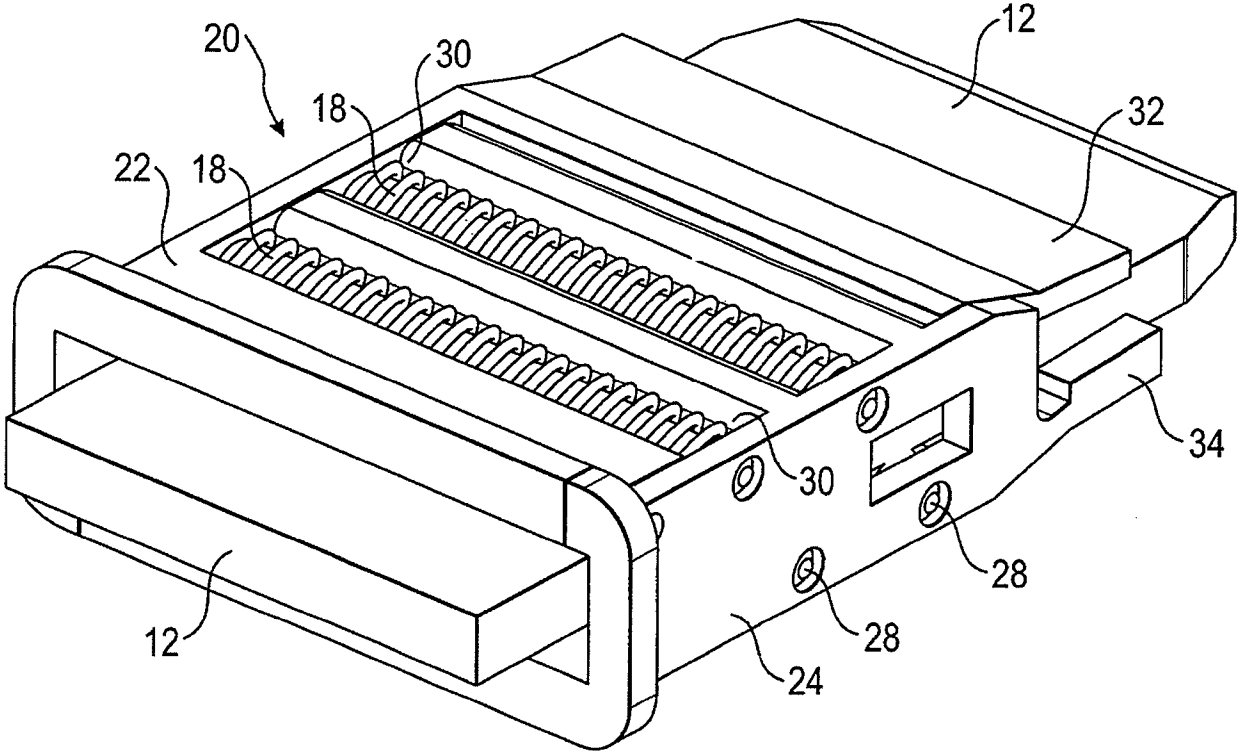
FIG. 8 is a further perspective view of the mounting member shown in FIG. 6 when a mating insertion-connected connector is inserted.

As is apparent from FIGS. 6 to 8, the mounting member 20 has, at an end arranged at the opposite end from the insertion end of the housing 10, two flaps 32, 34 which are integrally formed with respective ones of the mounting parts 22, 24 and which can be deflected elastically at free ends. A spacing between the flaps facing one another 32, 34 is smaller in this case than the thickness of the mating insertion-connected connector 12. When the mating insertion-connected connector 12 is inserted into the housing 10 and thus into the mounting member 20, the mating insertion-connected connector 12 in blade form fits through the mounting element 20 to the point where it is between the two flaps 32, 34. The flaps 32, 34 are thus bent open and away from one another elastically and the resulting force returning the flaps 32, 34 thus acts on the mating insertion-connected connector 12. This results in the mating insertion-connected connector 12 being fixed inside the housing 10, or rather inside the mounting member 20, in a corresponding way, the effect of which is to damp vibrations. This is an effective way of ensuring that the points of contact between the mating insertion-connected connector 12 and the coil springs 18 on the one hand and between the housing 10 and the coil springs 18 on the other hand are kept together, i.e. closed, effectively and that there is not even any brief opening of individual points of contact, even when severe mechanical vibrations act on the high-current insertion-connected connector having a mating insertion-connected connector inserted in it. This opening is what would in fact result if there were unwanted abrasion of an electrically conductive coating on the housing 10, the coil springs 18 and the mating insertion-connected connector 12, which would, in an undesirable way, possibly load individual parts of the coil springs, i.e. individual points of contact between the mating insertion-connected connector 12 and the coil springs 18 on the one hand and between the housing 10 and the coil springs 18, with particularly high local electrical currents. This damping of vibration is assisted in addition by the coil springs 18, or rather by the return force from them in the radial direction, i.e. perpendicularly to the central longitudinal axis of a given coil spring 18.

Figure 10:
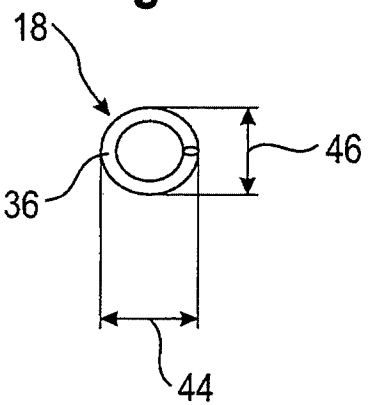
FIG. 10 is an end-on view of the contact member shown in FIG. 9.
Figure 9:
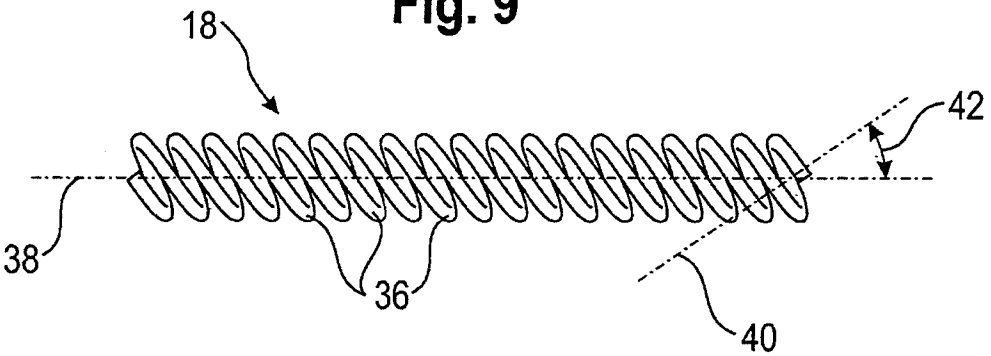
FIG. 9 is a view from the side of a contact member for the high-current insertion-connected connector shown in FIG. 1.

An illustrative and particularly preferred embodiment of the coil springs 18 is shown in FIGS. 9 and 10. The coil spring 18 has turns 36 and a central longitudinal axis 38. In itself, each individual turn 36 likewise has a central longitudinal axis 40. In a conventional coil spring, the central longitudinal axes 38 and 40 are in line with one another. In the coil spring shown however, the turns 36 are tilted relative to the central longitudinal axis 38 of the coil spring 18 and this produces a predetermined angle 42 between the central longitudinal axis 38 of the coil spring 18 and the central longitudinal axis 40 of a given turn 36, as shown in FIG. 9. Looked at in another way, the tilted turns result in the individual turns 36 being of an elliptical form in a plane perpendicular to the central longitudinal axis 38 of the coil spring 18, as shown in FIG. 10, i.e. in their not being of a circular form and in their having a major principal axis 44 and a minor principal axis 46.

This configuration for the coil springs 18 produces a radial preferred direction in which the coil springs 18 are particularly well able to be deformed elastically in the radial direction, i.e. produces high return forces from large deflections in which there is no plastic deformation. This is the direction defined by the minor semi-axis 46, i.e. a direction along a straight line in space which is aligned perpendicularly to the central longitudinal axis 38 of the coil spring 18 and which lies in a plane marked out between the central longitudinal axes 38 and 40. As can be seen from FIGS. 3, 4 and 5 in particular, the spigots 26 are of an elliptical form in cross-section, with the minor semi-axis of this elliptical configuration of the spigots 26 being aligned perpendicularly to a direction of insertion for the mating insertion-connected connector 12. This ensures that the coil springs 18 having tilted turns 36 of the kind shown in FIGS. 9 and 10 are, when inserted on the spigots 26, all arranged in precisely the same orientation in the housing 10, i.e. with their minor semi-axis 46 perpendicular to the direction of insertion of the mating insertion-connected connector 12 or in other words perpendicular to a longitudinal axis of the high-current insertion-connected connector. In this way, the minor semi-axis 46 of the coil springs 18 is aligned precisely in that direction in which the contact-making pressure for the points of contact of the coil springs 18, i.e. of their turns 36, needs to be applied to the housing 10 and the mating insertion-connected connector 12.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having describe the invention, what is claimed is:

1. A high-current insertion-connected connector for transmitting electrical currents, comprising:

a housing including electrically conductive material, said housing designed to be connected mechanically and electrically to a cable, and having at least one open side or end, and forming a chamber for receiving a mating insertion-connected connector;

said mating insertion-connected connector for insertion within said housing, made of an electrically conductive material;

at least one contact member arranged against the housing to make an electrical contact, at which there is an area of contact and a contact-making pressure, between the housing and the mating insertion-connected connector inserted into the housing, the at least one contact member including a coil spring, there being arranged in the housing, in the chamber to receive the mating insertion-connected connector; and a mounting member made of an electrically insulating material to hold the at least one contact member in a predetermined position, said mounting member receiving the mating insertion-connected connector, and including, for each of said at least one contact member in the form of a coil spring, a spigot having a free end, on each of which spigots the coil spring is so arranged that the spigot engages axially in turns of the coil spring.

2. The high-current insertion-connected connector of claim 1, wherein the mating insertion-connected connector includes a blade-type insertion-connected connector, an insertable blade, or a contact-making blade.

3. The high-current insertion-connected connector of claim 1, wherein a central longitudinal axis of the coil spring is aligned parallel to a straight line.

4. The high-current insertion-connected connector of claim 3, including two, three, four, or more coil springs, with central longitudinal axes each of said coil springs being aligned parallel to one another.

5. The high-current insertion-connected connector of claim 1, wherein that the at least one contact member in the form of said coil spring makes electrical and mechanical contact with the housing and the mating insertion-connected connector at radially outer sides of turns of the coil spring.

6. The high-current insertion-connected connector of claim 1, wherein a longitudinal center axis of at least one turn of the coil spring is tilted relative to a longitudinal center axis of the coil spring by a predetermined angle greater than zero.

7. The high-current insertion-connected connector of claim 1, including the mounting member formed in two parts.

8. The high-current insertion-connected connector of claim 1, wherein the mounting member includes apertures, with the at least one contact member in the form of a coil spring making electrical and mechanical contact with the housing by fitting through an aperture and projecting into the chamber within the housing for the mating insertion-connected connector.

9. The high-current insertion-connected connector of claim 1, wherein the mounting member includes two flaps facing one another, resiliently deflectable, said flaps having a spacing therebetween smaller than the thickness of the mating insertion-connected connector.

10. The high-current insertion-connected connector of claim 1, wherein a radial diameter of the at least one contact member in the form of said coil spring is perpendicular to a central longitudinal axis of the coil spring and greater than a distance between the housing and a mating insertion-connected connector inserted in the housing.

11. The high-current insertion-connected connector of claim 2, wherein a central longitudinal axis of the coil spring is aligned parallel to a straight line.

12. The high-current insertion-connected connector of claim 11, including two, three, four or more coil springs, with central longitudinal axes of each of said coil springs being aligned parallel to one another.

13. The high-current insertion-connected connector according to claim 3, wherein that the at least one contact member in the form of said coil spring makes electrical and mechanical contact with the housing and the mating insertion-connected connector at radially outer sides of turns of the coil spring.

14. The high-current insertion-connected connector of claim 3, wherein a longitudinal center axis of at least one turn of the coil spring is tilted relative to a longitudinal center axis of the coil spring by a predetermined angle greater than zero.

15. The high-current insertion-connected connector of claim 5, wherein a longitudinal center axis of at least one turn of the coil spring is tilted relative to a longitudinal center axis of the coil spring by a predetermined angle greater than zero.

16. The high-current insertion-connected connector of claim 7, wherein the mounting member includes apertures, with the at least one contact member in the form of a coil spring making electrical and mechanical contact with the housing by fitting through an aperture and projecting into the chamber within the housing for the mating insertion-connected connector.

17. The high-current insertion-connected connector of claim 8, wherein the mounting member includes two flaps facing one another, resiliently deflectable, said flaps having a spacing therebetween smaller than the thickness of the mating insertion-connected connector.

18. The high-current insertion-connected connector of claim 16, wherein the mounting member includes two flaps facing one another, resiliently deflectable, said flaps having a spacing therebetween smaller than the thickness of the mating insertion-connected connector.

* * * * *